United States Patent [19]

Nieuwkamp et al.

[11] Patent Number: 4,625,916

[45] Date of Patent: Dec. 2, 1986

[54] CYLINDRICAL INSET FOR A BINARY ATOMIZING NOZZLE

[75] Inventors: Wolfgang Nieuwkamp, Käppishäusern; Martin Junger, Grafenberg; Helmut Wenzel, Alstadt, all of Fed. Rep. of Germany

[73] Assignee: Lechler GmbH & Co., KG, Fellbach, Fed. Rep. of Germany

[21] Appl. No.: 630,269

[22] Filed: Jul. 12, 1984

[30] Foreign Application Priority Data

Jul. 16, 1983 [DE] Fed. Rep. of Germany ..... 3325741

[51] Int. Cl.[4] ..... B01F 3/04

[52] U.S. Cl. ..... 239/431

[58] Field of Search ..... 239/427.3, 430, 431; 261/76; 366/178

[56] References Cited

U.S. PATENT DOCUMENTS

| | | | |
|---|---|---|---|
| 795,044 | 7/1905 | Kraus | 239/427.3 |
| 3,341,131 | 9/1967 | Stallamp | 239/427.3 X |
| 3,409,274 | 11/1968 | Lawton | 261/76 X |
| 4,160,526 | 7/1979 | Flanagan | 239/431 X |
| 4,474,477 | 10/1984 | Smith et al. | 366/178 X |

FOREIGN PATENT DOCUMENTS

| | | | |
|---|---|---|---|
| 2627880 | 12/1977 | Fed. Rep. of Germany . | |
| 2907694 | 2/1979 | Fed. Rep. of Germany | 261/76 |
| 121386 | 9/1980 | Japan | 261/76 |

*Primary Examiner*—Andres Kashnikow

*Attorney, Agent, or Firm*—Shlesinger, Arkwright, Garvey & Fado

[57] ABSTRACT

A cylindrical inset forming a mixing chamber in a binary atomizing nozzle is mounted in a housing ahead of the nozzle discharge and is provided with radial boreholes. The liquid to be atomized, for instance water, and the atomizing gas, for instance air, are fed to the cylindrical inset, with the liquid arriving axially and the gas passing radially from an annular spacing surrounding the inset within the nozzle housing through the radial boreholes into the inset. The radial boreholes are located in several consecutive transverse plans when viewed in the direction of flow and are arrayed in mutually offset manner in the circumferential direction of the cylindrical inset.

14 Claims, 13 Drawing Figures

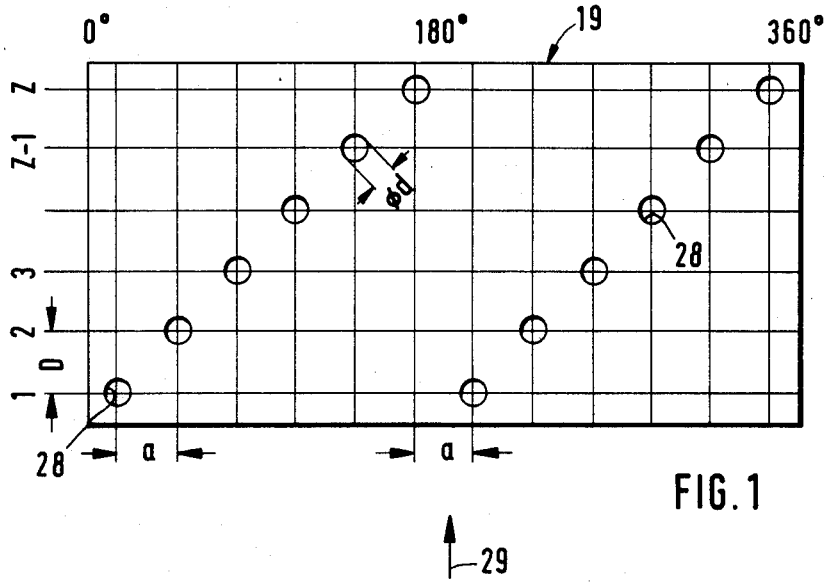
FIG. 1
FIG. 2
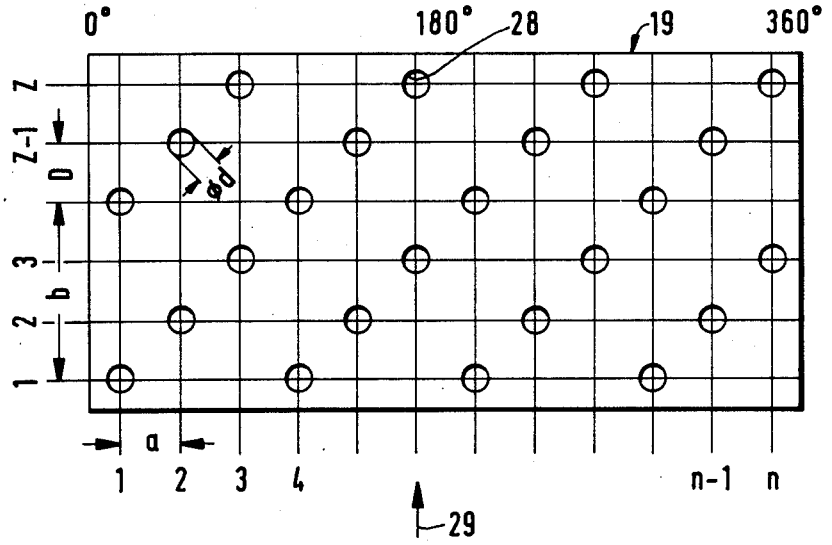

FIG. 7
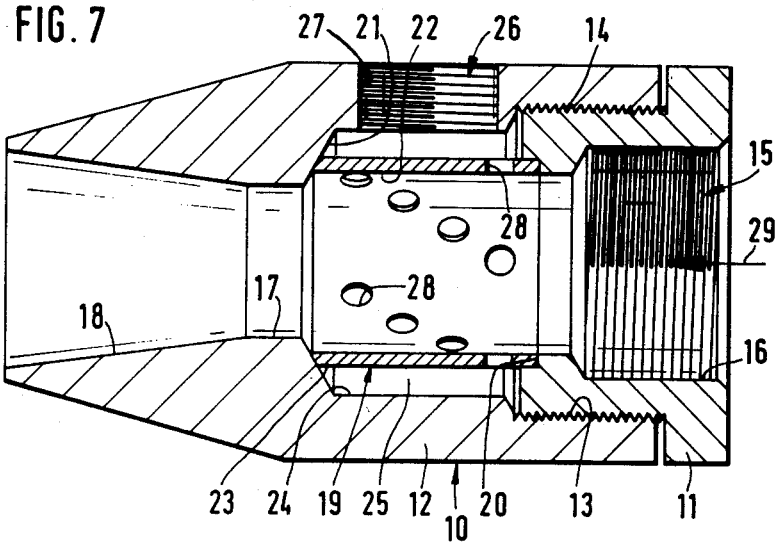
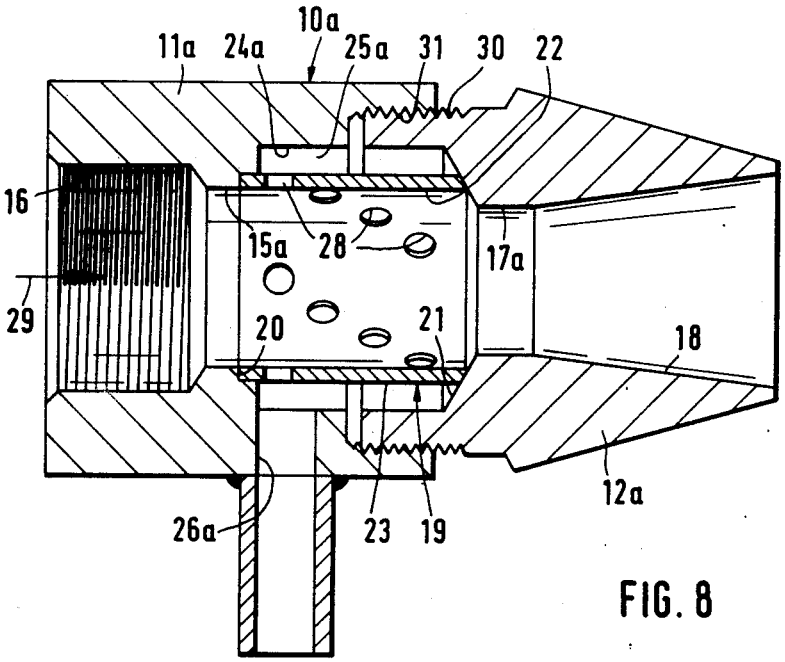
FIG. 8

CYLINDRICAL INSET FOR A BINARY ATOMIZING NOZZLE

BACKGROUND OF THE INVENTION

The invention concerns a cylindrical inset forming a mixing chamber for a binary atomizing nozzle which is mounted within a nozzle housing and ahead of the nozzle discharge. A plurality of radial boreholes are provided. The nozzle is supplied, on one hand, with the liquid, for instance water, to be atomized, and, on the other hand, with the atomizing gas, for instance air. The liquid is fed axially into the inset and the gas is fed radially through the radial boreholes from an annular space surrounding the inset in the nozzle housing into the inset.

A binary atomizing nozzle with the stated features has been disclosed in the German Offenlegungschrift No. 26 27 880. The known nozzle design is characterized in that the inflow and flow rates of the two individual phases are selected in relation to the remaining state parameters and the common outlet flow cross-section of a mixing chamber. The discharge rate equals the inherent speed of sound of the binary mixture and upon leaving the mixing chamber the mixture undergoes an impulsive drop in pressure.

The German Gebrauchsmuster No. 82 25 742 discloses another nozzle of the initially cited type. The essential features of this known binary atomizing nozzle consist in the inside chamber of a nozzle-type inset flaring in its terminal region facing the mixing zone. Communicating boreholes are radial or essentially radial and are provided in the flaring area and lead to an enclosing, annular space shaped in the manner of Laval nozzle to supply the gas. The flaring terminal region of the inner chamber of the inset acts as a pre-mixing zone for part of the gaseous medium with the liquid medium. The annular space is designed so that a pressure head of the gaseous medium is formed in the area of the communicating boreholes.

In the known nozzles of the state of the art outlined above, the gas is fed into the mixing chamber through several apertures located in one plane (German Gebrauchsmuster No. 82 25 742) or in only two planes (German Offenlegungsschrift No. 26 27 880), in either case perpendicularly to the liquid flow. In order to achieve optimal mixing of both components, gas and liquid, when this kind of gas supply to the mixing chamber exists, the design requires considerable expenditure. Moreover, the number of gas feed boreholes is inherently severely restricted when they are arranged in the direction of flow on a common axial generatrix of the mixing inset. It was found in practice that when radial boreholes are arrayed too tightly against each other in the axial direction (direction of flow), the required good mixing of the two phases, gas and liquid, is not assured per se.

OBJECTS AND SUMMARY OF THE INVENTION

It is the object of the present invention to achieve better mixing of the two phases, gas and liquid, and a more uniform atomization of the binary mixture, by resorting only to simple means.

This problem is solved by the invention in that the radial bores located in the direction of flow (axial direction of the cylindrical inset) in several consecutive transverse planes are arranged in mutually offset manner in the circumferential direction of the cylindrical inset.

The invention now makes it possible to provide a substantially larger number of gas feed boreholes in the cylindrical inset than in the known binary atomizing nozzles of the type being discussed. Due to the offset arrangement, as seen in the direction of flow, of the boreholes, liquid backflow to the outside is averted. Again, the drawback observed in the nozzles under discussion, namely gas feed boreholes which are consecutive in the direction of flow and hampering the air flow into the cylindrical inset of the known discussed nozzles, is also advantageously eliminated. As a whole, the gas feed boreholes can be better arrayed by means of the offset, both circumferentially and in the direction of flow. As a result, a larger gas intake cross-section is obtained and therefore the danger of clogging is less. The design of the inset of the invention, or of a binary atomizing nozzle equipped with such a nozzle, is simpler and also more rugged than that of comparable known insets or binary atomizing nozzles respectively. The possibly variable flow-rate range for the liquid increases because the dependence of the flow rate on the quality of atomization is reduced. Noise formation is reduced (for instance compared to Sonicore designs). Lastly, a binary atomizing nozzle equipped with the cylindrical inset of the invention also is characterized by a relatively low consumption of air.

DESCRIPTION OF THE DRAWINGS

Further designs, embodiments, applications and advantages can be inferred from the description below of illustrative modes of implementations.

FIGS. 1–4 show the geometric developments of various cylindrical insets of the invention;

DESCRIPTION OF THE INVENTION

Figure 3:
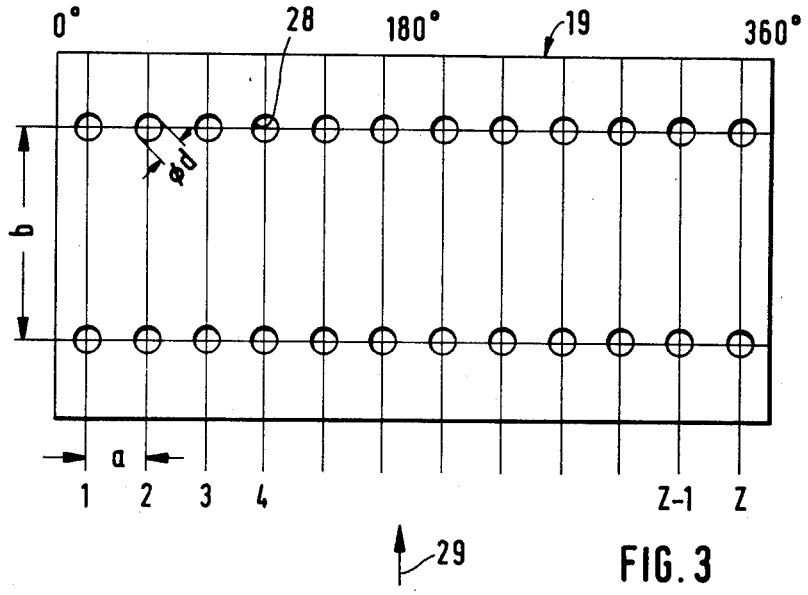

In the embodimcnt of a binary atomizing nozzle shown in FIG. 7, a nozzle housing 10 consists of a housing part 11 and a nozzle discharge part 12. In the embodiment of FIG. 7, the nozzle part 12 forms a part of the nozzle housing 10 and is provided with an inside thread 13 by means of which it is directly screwed onto the housing part 11 having an outer thread 14. The housing part 11 includes a stepped but continuous axial bore 15 for supplying a liquid to be atomized, for instance water. Bore 15 is provided at its widened segment with an inside thread 16 for connection to a suitable liquid feed line (omitted). The discharge part 12 of the nozzle is screwed onto the housing part 11 and includes a multiply stepped and continuous axial bore denoted as a whole by 17. The bore 17 conically flares at its front end (left in FIG. 7) into a widening 18 forming the nozzle discharge.

A cylindrical inset denoted as a whole by 19 is mounted within the nozzle housing 10 formed by parts 11, 12 and rests toward the rear on an offset 20 of the housing part 11 and toward its front end directly on a shoulder 21 of the nozzle discharge part 12. The cylindrical inset 19 is tubular in shape and its axial borehole 22 is flush with the already cited transmission bores 15 and 17 of tbe nozzle housing 10. The dimensions of the cylindrical inset 19 are such that an annular channel 25 is formed between outer wall 23 and inside wall 24 of the widened part of the borehole 17 in the nozzle discharge part 12. A borehole 26 issues into the annular channel 25 and serves to feed a gaseous medium, for instance air, into the annular channel 25. Borehole 26 is provided with an inside thread 27 for hook-up to a suitable gas supply line (omitted).

The cylindrical inset 19 also is provided with a number of radial boreholes denoted by 28 which in the embodiment of FIG. 7 are arranged on a conceptual helical lines surrounding the cylindrical inset 19. The helical arrangement of the radial boreholes 28 in the cylindrical inset 19 is visualized in further detail in the geometric developmcnt of FIG. 1. As shown, two helical lines are provided, of which the spacing and slope are so selected that no radial borehole 28 is located behind another in the axial or flow direction 29. FIGS. 1 and 7 make it clear that the two conceptual helical lines formed by the two rows of radial boreholes 28 evince the same slope.

Due to the tubular design on one hand and the radial boreholes 28 on the other, both the liquid and the gas fed into the annular chamber 25 at 26 arrive inside the cylindrical inset 19. Due to the conditions described above, a thorough mixing of the two components, liquid and gas, takes place inside the cylindrical inset 19, whereafter the binary mixture is made to pass through the nozzle discharge 18 for use. The cylindrical inset 19, therefore, operates as a mixing chamber for the two components, liquid and gas. Because of the helical arrangement already cited of the radial boreholes 28, it is advantageously feasible to arrange a large number of such radial boreholes 28 on the cylindrical inset 19, equally distributed over its circumference, without thereby degrading the gas flows fed through the individual boreholes 28 to the inside of the inset 19.

FIG. 1 shows in detail that the lateral offset between any two particular adjacent radial boreholes assumes the value "a". The spacing measured in the axial or flow direction 29 between any two adjacent radial boreholes 28 is characterized in FIG. 1 by the value D. It can be seen that the spacings "a" and "D" correspond or are equal to each other and, consequently, the slopes of the conceptual helical lines always amount to 45°. The diameter of the individual radial boreholes 28 is denoted by "d" in FIG. 1.

The embodiment of a binary atomizing nozzle shown in FIG. 8 is similar in design and operation to the embodiment of FIG. 7 and therefore the mutually corresponding parts in FIG. 8 are denoted by the same reference numerals as those in FIG. 7. Deviations from FIG. 7 are indicated by the subscript "a". The differences between the embodiments of FIG. 8 and FIG. 7 are explained below.

The nozzle discharge part, here denoted by 12*a*, is provided with an outer thread 30 by means of which it is screwed to a corresponding inner thread 31 of the housing part 11*a*. The radial feed denoted by 26*a* is provided in the housing part 11*a* in the embodiment of FIG. 8.

Figure 9:
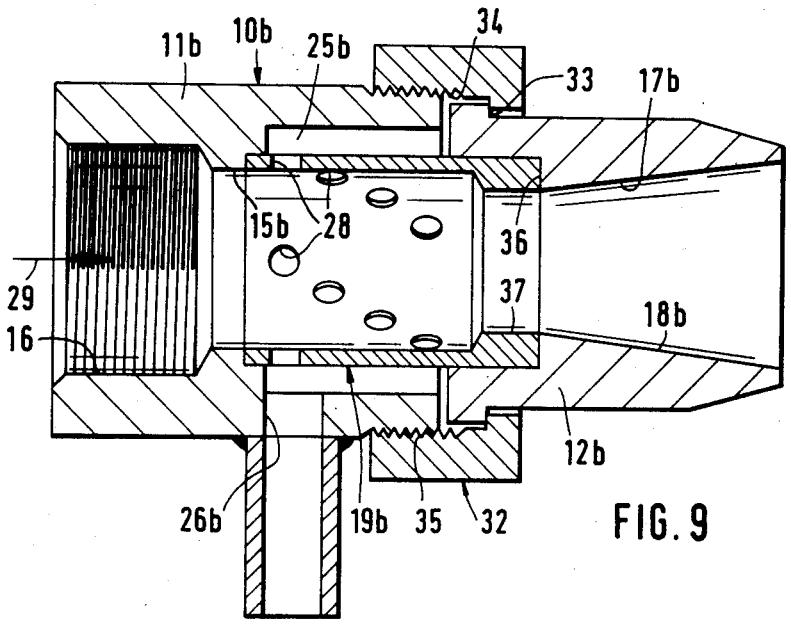

The design and operation of the binary atomizing nozzle of FIG. 9 also corresponds essentially to the embodiment of FIGS. 7 and 8. The nozzle of FIG. 9 accordingly is shown with corresponding reference numerals which are partly supplemented by the subscript "b". The embodiment of FIG. 9 discloses that the two parts 11*b* and 12*b* forming the nozzle housing 10*b* are not directly screwed together but instead, are joined by the intermediary of a coupling nut 32. The coupling nut 32 rests on a collar 33 of the nozzle discharge part 12*b* and includes an inside thread 34 by means of which it is screwed on a corresponding outer thread 35 of the housing part 11*b*.

A further feature of the embodiment of FIG. 9 is the inner geometry of the cylindrical inset 19*b*. This inset 19*b* is provided at its end on the side of the nozzle discharge resting on an offset 36 of the nozzle discharged part 12*b* with a stepped borehole 37 which to some extent already forms part of the nozzle discharge 18*b*.

Figure 10:
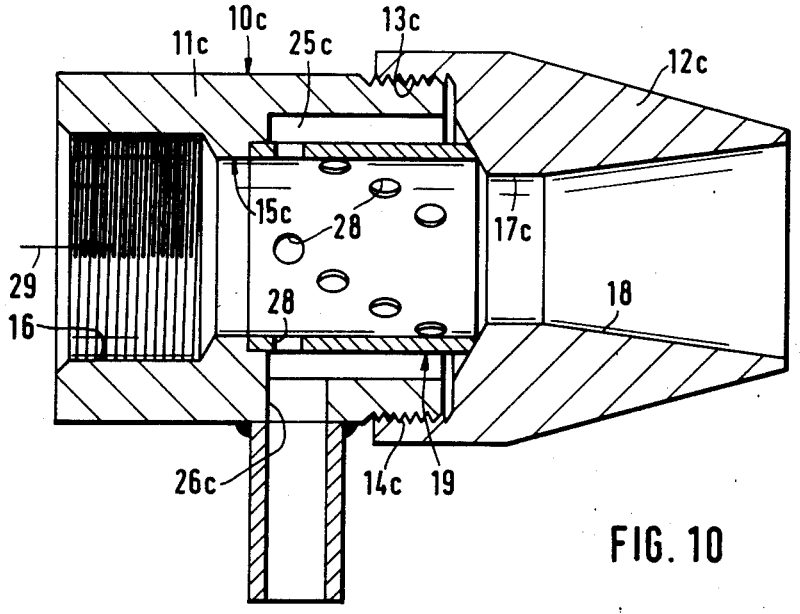

Again the design of the embodiment of FIG. 10 is closely similar to the variation of FIG. 8 and therefore the same reference numerals are used again, complemented in part by the subscript "c". The differences over the embodiment of FIG. 8 in this case consists in that the nozzle discharge part, denoted by 12*c* is provided with an inside thread 13*c* by means of which it is screwed onto a corresponding outer thread 14*c* of the housing part 11*c*. Contrary to the embodiment of FIG. 7, the variation shown in FIG. 10—just as in the case of the embodiments of FIGS. 8 and 9—includes the lateral gas supply 26*c* in the very housing part 11*c*.

Figure 11:
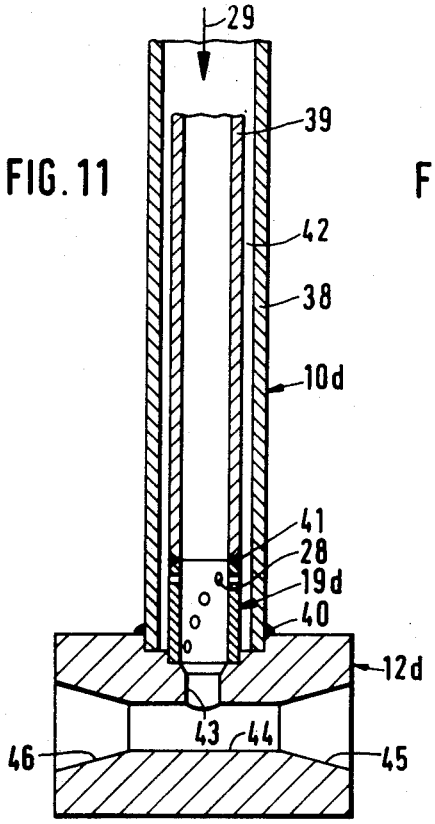

The variation of FIG. 11 differs substantially from the previously shown designs. The nozzle housing, here denoted as a whole by 10*d*, consists of two mutually concentric tubes 38,39 with the inside tube 39 being used to supply the liquid. The outer tube 38 is welded at 40 to the nozzle discharge part 12*d*. The cylindrical inset 19*d* is welded at 41 to the front end of the inside tube 39 and is provided with an inside and outside diameter corresponding to the dimensions of the inside tube 39. An annular channel 42 is formed between the inside tube 39 and the outside tube 38 in order to supply gas to the cylindrical inset 19*d*. Contrary to the embodiments of FIGS. 7–10, the gas feed in this case is not radial, rather it is initially axial, i.e. in the flow direction 29. The gas will be made to flow radially only by means of the radial boreholes 28 of the cylindrical inset 19*d* which again are arranged helically. The gas thus arrives radially into the mixing chamber—formed by the cylindrical inset 19*d*—for the two components, liquid and gas.

Thereupon, the binary-phase mixture prepared within the cylindrical inset 19*d* arrives at an axial borehole 43 of the nozzle discharge part 12*d* which in turn issues into a transverse nozzle discharge borehole 44. The nozzle discharge borehole 44 widens bilaterally and conically with respect to the two lateral nozzle discharges denoted by 45 and 46.

Figure 12:
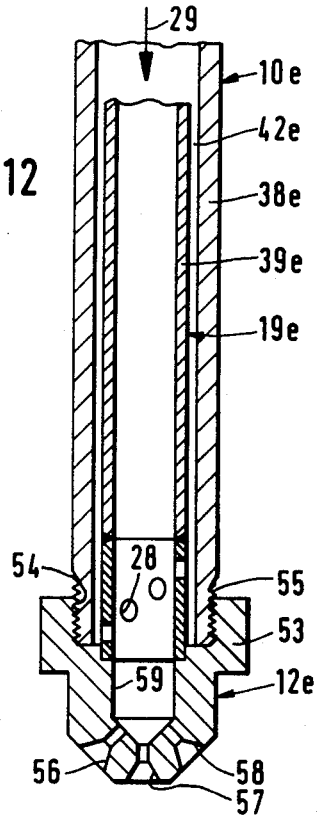

In principle the embodiment of FIG. 12 is similar to the design of the embodiment of FIG. 11. Therefore, the mutually corresponding parts are denoted in this case also by the same reference numerals, complemented by the subscript "e". One of the differences with respect ot the embodiment of FIG. 11 is the design and arrangement of the nozzle discharge part denoted in FIG. 12 by 12*e*. This nozzle discharge part 12*e* comprises a widened hook-up part 53 provided with an inside thread 54. The nozzle discharge part 12*e* is screwed onto a corresponding outer thread 55 of the outer tube 38*e*. Another feature of the embodiment of FIG. 12 is the design of the nozzle discharges proper. This design includes three conically flaring single nozzle discharges 56,57 and 58 arrayed in a fan-like manner issuing from a central borehole 59 within the nozzle discharge part 12*e*.

Figure 13:
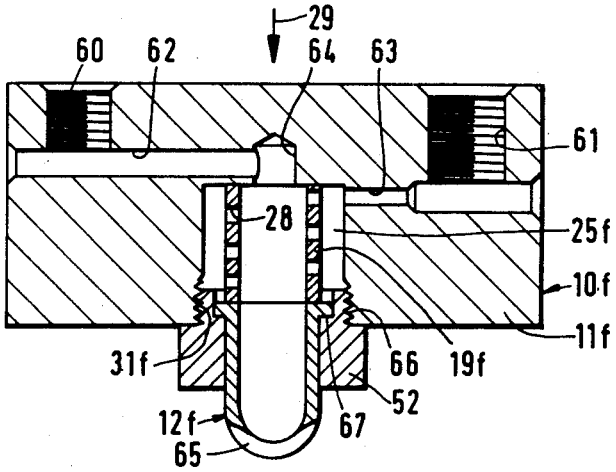

FIG. 13 shows an embodiment of a binary atomizing nozzle of which the characteristic essentially is a special design of the nozzle housing part denoted by 11*f*. This part 11*f* comprises two threaded hook-up means 60,61 in the axial, that is in the flow direction 29, each issuing into a transverse feed bore 62 and 63 resp. The threaded hook-up 60 and the feed borehole 62 supply the liquid medium and issue into an axial borehole 64 from where the liquid medium passes into the cylindrical inset 19*f*. On the other hand, the threaded hook-up 61 and the feed borehole 63 supply the gaseous medium directly into the annular space 25*f* of the nozzle housing 10*f* surrounding the cylindrical inset 19*f*. From there the gaseous medium passes through the radial boreholes 28 and also arrives inside the cylindrical inset 19*f* where it is thoroughly mixed with the liquid medium. Then the mixture arrives at the nozzle discharge part 12*f* which is rounded at its front end and is provided with a slotted nozzle discharge 65 whereby the mixture is discharged in the geometry of a fan-shaped flat jet.

Another feature of the embodiment of FIG. 13 is that the nozzle housing part 11*f* is provided with an inside thread 31*f* into which is screwed a separate threaded part 52 with a corresponding outer thread 66. As can be noted, the threaded part 52 holds the nozzle discharge part 12*f* in the nozzle housing part 11*f*, the threaded part 52 rests on a collar 67 of the nozzle discharge part 12*f*.

Regarding the cylindrical insets 19–19*f* which are used in the various above described embodiments or applications, their geometry in no way is restricted to the basic variation shown for instance in FIGS. 7–10, namely of two helical rows of radial boreholes 28. Instead, further advantageous designs are conceivable, some of which are shown in part in FIGS. 2–4. In the embodiment of FIG. 2 for instance, the radial boreholes 28 are arrayed in a total of five conceptual helical lines on the circumference of the cylindrical inset 19. The number and the (equal) slopes of the conceptual helical lines are chosen in such a manner that every two adjacent helical lines overlap in the axial or flow direction 29, whereby two radial boreholes 28 will always be consecutive in each generatrix pointing in the direction of flow 29. The spacing "b" shown in FIG. 2 between two radial boreholes 28 located on a common, axially-directed generatrix of the cylindrical inset 19 in this case amounts to at least five times the borehole diameter "d". As a result, the individual gas flows passing through the radial boreholes 28 into the cylindrical inset 19 will be reliably prevented from degrading each other. This is so even though a comparatively large number of radial boreholes 28 are uniformly distributed over the circumference of the cylindrical inset 19.

FIG. 3 shows another variation of radial boreholes 28 uniformly distributed over the circumference of the cylindrical inset 19 without thereby degrading the individual gas flows. Again, a spacing "b" is achieved for this distribution between any two radial boreholes 28 which are consecutive as seen in the flow direction 29. The spacing "b" is at least five-fold the diameter "d" of a radial borehole 28. As shown by FIG. 3, the array can be construed as being only two radial boreholes 28 on each conceptual helical line. The lateral offset in each case is characterized by the size "a".

Figure 4:
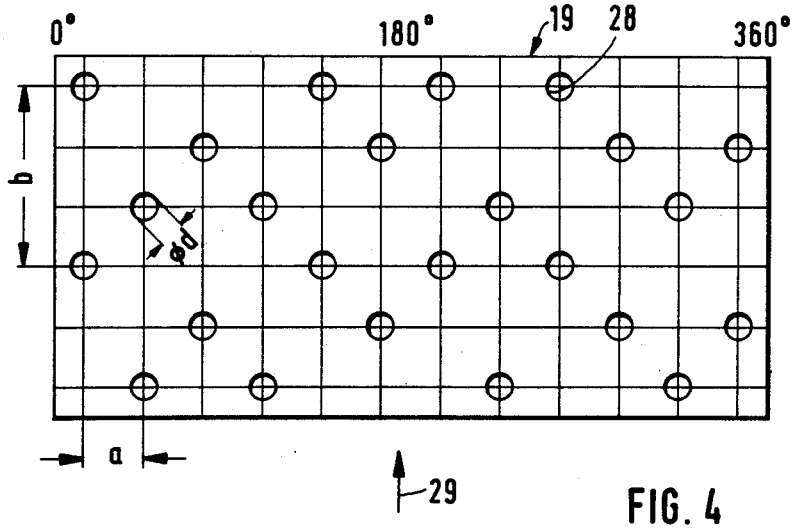

On the other hand, the embodiment of FIG. 4 represents an arbitrary arrangement of the individual radial boreholes 28 around the circumference of the cylindrical inset 19. However, as regards the lateral offset "a", or the spacing "b" in the flow direction 29, the assumptions already stated above for the remaining embodiments of FIGS. 1–3 apply here too. The variations of FIGS. 1–3, wherein the radial boreholes 28 are arranged in a regular array, are likely to be preferred to an arbitrary array as in FIG. 4 when the fabrication process is considered.

Cylindrical insets 19, with distributed radial boreholes as in FIGS. 1–4, are preferably, used in binary atomizing nozzles wherein the cylindrical inset is eccentrically arranged, i.e. centrally displaced within the annular space 25 (see also FIGS. 7–10). The insets 19 are away from the radial gas feed 26 in order to achieve uniform gas speed across the entire circumference of the cylindrical inset and hence to make the inflow conditions correspondingly uniform at all radial boreholes 28.

Besides the variations in radial borehole 28 arrays at the circumference of the cylindrical inset 19 as represented in the FIGS. 1–4, further arrangements are conceivable. For instance, the radial boreholes 28 may be located in several zig-zag lines arrayed across the circumference of the cylindrical inset 19 and, preferably, subtending equal angular spaces to one another. These zig-zag lines should subtend regular and preferably equal angles and point as a whole in the axial direction of the cylindrical inset 19.

In a further conceivable variation, the radial boreholes 28 can be arranged on a single conceptual helical line surrounding the cylindrical inset 19 with such a slope that the axial generatrices of the cylindrical inset 19 are always intersected by several pitches or slopes of helical lines. The result is an array and distribution of the individual radial boreholes 28 similar to those of the embodiment of FIG. 2.

Figure 5:
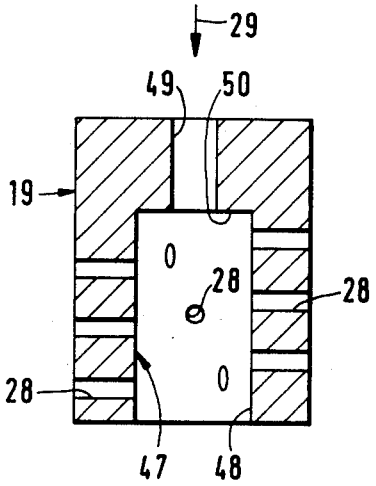
FIGS. 5 and 6 are various embodiments of a cylindrical inset each time shown in longitudinal section; and, FIGS. 7–13 are various applications of cylindrical insets of the invention.
Figure 6:
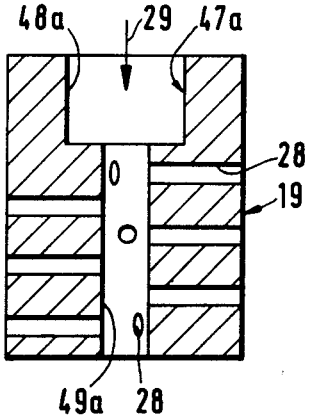

Besides the distribution and arrangement of the radial boreholes 28, the cylindrical inset 19 itself can be designed in different ways for the most diverse applications. For instance, the inside geometry in particular can deviate from the uniform tubular or cylindrical shape shown illustratively in FIGS. 7–9 and 11. FIGS. 5 and 6 show other possibilities on shaping the inside space of the cylindrical inset 19–19*f*.

In FIG. 5, the inside space, denoted as whole by 47, of the inset 19 forms the mixing zone for the two components, liquid and gas, and is designed to be widening stepwise in the flow direction 29. In this design the radial boreholes 28 for the gas feed into the inside issue in the part 48 of the inside space 47 and which has the larger diameter. The narrower part 49 is joined by the widened part 48 of the inside space 47 and from here the binary mixture passes into the nozzle discharge (omitted). The comparatively constricted borehole 49 is ahead of the feed and throttles the liquid flow. Consequently, the volume of liquid is less affected by the entering gas flows.

FIG. 6 shows a slightly deviating variation. In this case, the inside space denoted as a whole by 47*a* includes a part 48*a* having a larger diameter which passes stepwise into part 49*a*. Contrary to the design of FIG. 5, the radial boreholes in this case issue into the part 49*a* with a reduced diameter. Therefore, longer paths are provided for the radial boreholes 28 and thereby provide more throttling of the gas medium compared to the liquid medium. As a result, the gas affects the liquid flow less.

In summary the following advantages hold for the embodiments of FIGS. 5 and 6: the curve relating pressure and volume flow becomes shallower by throttling one medium in a long and narrow borehole, i.e., the two media are more easily and determinatively controlled by their own pressure.

While this invention has been described as having a preferred design, it is understood that it is capable of further modifications, uses and/or adaptations of the invention following in general the principles of the invention and including such departures from the present disclosure as come within known or customary practice in the art to which the invention pertains, and as may be applied to the central features herein before set forth, and fall within the scope of the invention of the limits of the appended claims.

We claim:

1. A binary atomizing nozzle, comprising:
(a) a nozzle housing having a liquid inlet, a gas inlet and a mixture outlet;
(b) a multiply stepped and continuous axial bore in said housing between said liquid inlet and said mixture outlet, one of the steps defines an angularly disposed shoulder proximate said outlet and another of said steps defines an offset proximate said liquid inlet;
(c) a cylindrical inset coaxially mounted in said bore and extending between and clamped between said shoulder and said offset and said inset having an outer diameter less than the diameter of said bore between said shoulder and said offset for therewith defining an annular channel;
(d) said inset has a bore coaxial with said housing bore providing a mixing chamber;
(e) said gas inlet disposed transverse to the axis of said inset and communicating with said channel for providing atomizing gas thereto; and
(f) a plurality of radially extending boreholes in said inset permitting flow of the atomizing gas from said channel into said mixing chamber, said boreholes disposed in a plurality of arrays extending between said offset and said shoulder and said arrays in successive uniformly spaced apart planes disposed transverse to the axes of said bores and the boreholes of each array are mutually angularly offset around the axis of said inset so that the boreholes of any one array are axially aligned in the direction of flow with the boreholes of only one other array for maximizing the number of boreholes in said inset and causing uniform gas speed around the circumference of said inset and therefore uniform inflow conditions at all boreholes.

2. The nozzle as defined in claim 1 wherein:
(a) a plurality of lines intersect the boreholes of said successive arrays and said lines subtend equal angles with respect to the axis of said inset and subtend equal angles with respect to each other.

3. The nozzle as defined in claim 2, wherein:
(a) said lines being axially disposed.

4. The nozzle as defined in claim 1, wherein:
(a) the boreholes of said arrays are arranged on a single helical line surrounding said inset.

5. The nozzle as defined in claim 1, wherein:
(a) the boreholes of said arrays being arranged on a plurality of helical lines surrounding said inset, said lines having the same pitch and the axial generatrices of said inset being intersected by a plurality of said lines.

6. The nozzle as defined in claim 1, wherein:
(a) the spacing between boreholes axially aligned in the direction of flow being at least 5 times the diameter of a borehole.

7. A binary atomizing nozzle, comprising:
(a) a generally cylindrical housing part having an inlet end portion and an outlet end portion and a stepped bore extending therebetween and said housing part including a threaded portion;
(b) said inlet end portion including means for connection to a source of a liquid to be atomized and said outlet end portion including an annular offset concentric with and extending radially from said bore and axially toward said inlet end portion;
(c) a generally cylindrical nozzle part having an inlet end portion and an outlet end portion and a stepped bore extending therebetween and said nozzle part including a threaded portion cooperating with said housing part threaded portion for securing said parts together so that said bores are coaxially aligned for providing a continuous liquid flow path;
(d) said nozzle part bore including a shoulder opposite said offset and disposed at an angle to the axes of said bores;
(e) said bores having adjacent cooperating portions extending between said offset and said shoulder defining a chamber therebetween;
(f) a cylindrical inset positioned in said chamber and having a first end received in said offset and a second end bearing on said shoulder and being clamped between said offset and said shoulder for maintaining alignment in said chamber when said parts are secured together and said inset including a bore defining a mixing chamber coaxial with said bores and said inset having an outer diameter less than the inner diameter of said first mentioned chamber for therewith defining an annular channel;
(g) means communicating with said channel for supplying an atomizing gas thereto;
(h) a plurality of radially extending boreholes in said inset permitting flow of the atomizing gas from said channel into said mixing chamber, said boreholes disposed in a plurality of arrays extending between said offset and said shoulder and said arrays in successive uniformity spaced apart planes disposed transverse to the axes of said bores and the boreholes of each array are mutually angularly offset around the axis of said inset so that the boreholes of any one array are axially aligned in the direction of flow with the boreholes of only one other array for maximizing the number of boreholes in said inset and causing uniform gas speed around the circumference of said inset and therefore uniform inflow conditions at all boreholes; and,
(i) said nozzle part outlet end portion including a flaring discharge communicating with said mixing chamber.

8. The atomizer as defined in claim 7 wherein:
(a) a plurality of generatrices subtending the boreholes of said successive arrays define a plurality of lines subtending equal angles with respect to the axis of said inset and subtending equal angles with respect to one another.

9. The atomizer as defined in claim 8, wherein:
(a) each of said lines being axially disposed.

10. The atomizer as defined in claim 7, wherein:
(a) the boreholes of said arrays are arranged on a single helical line surrounding said inset, the turns of said line intersecting each axial generatrix of said inset a plurality of times.

11. The atomizer as defined in claim 7, wherein:

(a) the boreholes of said arrays being arranged on a plurality of helical lines surrounding said inset, said lines having the same pitch and the axial generatrices of said inset being intersected by a plurality of said lines.

12. The atomizer as defined in claim 7, wherein:

(a) the spacing between boreholes axially aligned in the direction of flow being at least 5 times the diameter of a borehole.

13. The nozzle of claim 7 wherein:

(a) said shoulder being disposed perpendicular to the axes of said bores.

14. The nozzle of claim 7 wherein:

(a) said means for supplying the atomizing gas being disposed perpendicular to the axes of said bores.

* * * * *